US007988314B2

(12) United States Patent
Nichols et al.

(10) Patent No.: US 7,988,314 B2
(45) Date of Patent: Aug. 2, 2011

(54) QUADRANT LIGHTING APPARATUS

(75) Inventors: John E. Nichols, St. Louis, MO (US); Roy E. Avery, Chesterfield, MO (US)

(73) Assignee: Kemco Aerospace, Kirkwood, MO (US)

( * ) Notice: Subject to any disclaimer, the term of this patent is extended or adjusted under 35 U.S.C. 154(b) by 127 days.

(21) Appl. No.: 10/886,222

(22) Filed: Jul. 7, 2004

(65) Prior Publication Data

US 2006/0007678 A1 Jan. 12, 2006

(51) Int. Cl.
*F41G 1/34* (2006.01)

(52) U.S. Cl. ..... 362/110; 362/800

(58) Field of Classification Search ..... 362/110, 362/800

See application file for complete search history.

(56) References Cited

U.S. PATENT DOCUMENTS 4,283,757 A * 8/1981 Nalbandian et al. ..... 362/120
5,064,067 A * 11/1991 McAllister et al. ..... 206/420
5,199,177 A * 4/1993 Hutchins et al. ..... 33/348.2
5,803,579 A * 9/1998 Turnbull et al. ..... 362/800
6,042,248 A * 3/2000 Hannah et al. ..... 362/252
6,045,240 A * 4/2000 Hochstein ..... 362/800
6,192,633 B1 * 2/2001 Hilbert ..... 52/2.18
6,793,366 B2 * 9/2004 Chun ..... 362/184

OTHER PUBLICATIONS

Technical Manual for Gunner's Quadrant and Carrying Case/Headquarters, Department of the Army and U.S. Marine Corps/Sep. 5, 1988.

* cited by examiner

*Primary Examiner* — Sandra L O Shea
*Assistant Examiner* — William J Carter
(74) *Attorney, Agent, or Firm* — Dennis A Bennett

(57) ABSTRACT

A lighting apparatus for a Gunner's Quadrant including a housing and a flexible circuit board including lights. The lighting apparatus illuminates portions of the M1 A1 or M1 A2 Gunner's Quadrant. The lighting apparatus may be removably attached to the Gunner's Quadrant. The invention also includes a method of manufacturing a lighting apparatus for a Gunner's Quadrant, including applying a flexible circuit board including lights to a housing.

22 Claims, 15 Drawing Sheets

QUADRANT LIGHTING APPARATUS

FIELD OF THE INVENTION

The invention relates to a quadrant lighting apparatus, such as a quadrant lighting apparatus for use in conjunction with the M1 A1 Gunner's Quadrant or the M1 A2 Gunner's Quadrant, used with various weapons, such as artillery pieces and howitzers.

DESCRIPTION OF RELATED ART

The M1 A1 Gunner's Quadrant and the M1 A2 Gunner's Quadrant are portable precision-leveling instruments generally used for measuring the elevation or depression angles of weapons, such as artillery pieces and howitzers. The M1 A1 Gunner's Quadrant and the M1 A2 Gunner's Quadrant may also be used for checking the adjustment of the elevating mechanisms and checking the accuracy of sighting and fire control equipment of the weapon, such as the artillery piece or the howitzer. An M1 A1 Gunner's Quadrant 1 is shown in FIG. 1.

In practice, the Gunner's Quadrant is used to verify or double-check the sighting of the artillery piece or howitzer as part of a fire control routine. For example, the artillery piece or howitzer may have a manually rotatable fire control adjusting system that provides a coarse measurement. The Gunner's Quadrant may then be used to manually verify or assist in adjusting the fire control of the weapon. If the weapon is moved from one location to another location between firing artillery rounds, then rechecking of the fire control is often necessary. Also, the inherent movement resulting from firing the artillery piece or howitzer may necessitate readjustment or reverification of the fire control system. Certain weapons use optical instruments to determine the fire control. The Gunner's Quadrant may then be used to verify the optical instruments' fire control.

The operator of the weapon is instructed to contain the M1 A1 Gunner's Quadrant and the M1 A2 Gunner's Quadrant in a M82 Carrying Case when the Gunner's Quadrant is not in use. The M82 Carrying Case protects the Gunner's Quadrant from physical contact or debris that may damage or otherwise interfere with the operation of the Gunner's Quadrant. A M82 Carrying Case 5 is shown in FIG. 2. As can be readily determined from FIG. 2, the M82 Carrying Case provides a defined space in which to contain the Gunner's Quadrant. The M82 Carrying Case is made of a hard aluminum die casting material with some internal cork padding and/or gussets, and although it is padded, it cannot expand to accommodate different-sized articles contained therein. The M82 Carrying Case has been in production and in use in the United States Military for decades, and there is no indication that the M82 Carrying Case will be redesigned. Therefore, any improvements, modifications, and/or accessories relative to the Gunner's Quadrant must fit within the Carrying Case.

The M1 A1 Gunner's Quadrant and the M1 A2 Gunner's Quadrant are used with such weapons of the United States Military as the M198, the M155 Lightweight, the M119, and the M102 howitzer, the M109 self-propelled howitzer and the M1 tank.

The M1 A2 Gunner's Quadrant uses tritium, a radioactive material, under its liquid level bubble vial. Environmental health concerns exist with respect to the use of the radioactive materials. It is desired to eliminate the use of the radioactive materials.

The Gunner's Quadrant includes a liquid level bubble vial 4, a micrometer 3, and a left elevation scale 7 and a right elevation scale 6 (shown in FIG. 1). It is necessary for the operator to observe the measurements obtained from viewing the level and the scales and then to adjust the micrometer accordingly. These features are difficult to efficiently and accurately operate in low-light ambient conditions without some external illumination and assistance of additional personnel.

Today's military often prefers to operate in low-light conditions. Up until this invention, the operator of the artillery weapon under low-light conditions was required to provide external illumination to the Gunner's Quadrant or refrain from operating the Gunner's Quadrant during low-light or dark conditions. The external illumination may include a flashlight or other lighting device. Unfortunately, a typical flashlight provides too much light and may be easily detected by an enemy combatant thereby revealing the location of the artillery weapon to the enemy combatant. Moreover, the operator of the weapon may need assistance from a fellow operator to provide or hold the flashlight thereby reducing the efficiency and effectiveness of the artillery operation team.

SUMMARY OF THE INVENTION

Embodiments, including the technical features of the present invention for which protection is sought, are illustrated and described herein and include a quadrant lighting apparatus to be used in conjunction with an artillery piece, such as a howitzer, and more particularly a M1 A1 Gunner's Quadrant and a M1 A2 Gunner's Quadrant. The quadrant lighting apparatus illuminates portions of the M1 A1 and M1 A2 Gunner's Quadrant. The quadrant lighting apparatus removably attaches to either the M1 A1 or the M1 A2 Gunners Quadrant. The quadrant lighting apparatus, after attaching to the Gunner's Quadrant, may then be stored with the Gunner's Quadrant in a defined space of a M82 Carrying Case.

The quadrant lighting apparatus provides illumination to certain pre-determined portions of the Gunner's Quadrant namely, the liquid level 4, the micrometer 3, the left elevation scale 7, and the right elevation scale 6. It is important that the amount of light provided by the quadrant lighting apparatus is enough to provide the operator with the ability to read the quadrant, while not revealing the position of the artillery weapon to an enemy combatant.

The quadrant lighting apparatus is removably attachable to the Gunner's Quadrant without undue time and/or labor. A clipping mechanism of the quadrant lighting apparatus may attach the quadrant lighting apparatus to the Gunner's Quadrant. Should the operator desire to remove the quadrant lighting apparatus from the Gunner's Quadrant, it may be easily removed in the field by unclipping the Gunner's Quadrant from the quadrant lighting apparatus.

The quadrant lighting apparatus uses a plurality of LEDs (light emitting diodes) to provide the illumination for the Gunner's Quadrant. By using the plurality of LEDs, and focusing their light in certain and specific directions, the whole quadrant lighting apparatus does not create a noticeable "hot spot" or light signature for an enemy combatant to use to locate the artillery piece or howitzer.

The quadrant lighting apparatus provides the operator with the ability to read and use the Gunner's Quadrant in contraindicated ambient conditions, such as dark or low light conditions, which are often more preferable for a military operation. Importantly, an extra operator is not needed to operate and/or manually hold the quadrant lighting apparatus.

After attaching the quadrant lighting apparatus to the Gunner's Quadrant, the combination of the Gunner's Quadrant and the quadrant lighting apparatus will fit into the military's M82 Carrying Case. The M82 Carrying Case provides a defined space with a confined environment for the Gunner's Quadrant with little room for any extra items. The M82 Carrying Case is made of a hard aluminum die casting material and will, therefore, not expand to accommodate an accessory. Importantly, the quadrant lighting apparatus of the present invention fits into the confined space of the M82 Carrying Case.

The quadrant lighting apparatus is also made of a lightweight material and does not appreciably add to the overall weight of the M82 Carrying Case and the Gunner's Quadrant.

The quadrant lighting apparatus includes a housing and a flexible circuit board. The housing is made of a lightweight material, such as a metal or a plastic. The flexible circuit board is a lamination of different materials that provide electrical connectivity between the electrical components, including a lighting source.

It is an aspect of the present invention to provide illumination for a Gunner's Quadrant without creating a hot spot or a light signature noticeable to an enemy combatant.

It is another aspect of the present invention to provide a lighting apparatus for a Gunner's Quadrant that may be contained in the standard issue M82 Carrying Case.

It is another aspect of the present invention to allow the operator of an artillery piece to illuminate the Gunner's Quadrant without assistance from a second operator.

It is another aspect of the present invention to provide lighting means that do not use radioactive materials.

It is still a further aspect of the present invention to provide a durable yet lightweight lighting apparatus that may be removably connected to the Gunner's Quadrant.

These and other aspects of the present invention are achieved herein.

DETAILED DESCRIPTION OF THE PREFERRED EMBODIMENT

Figure 3:
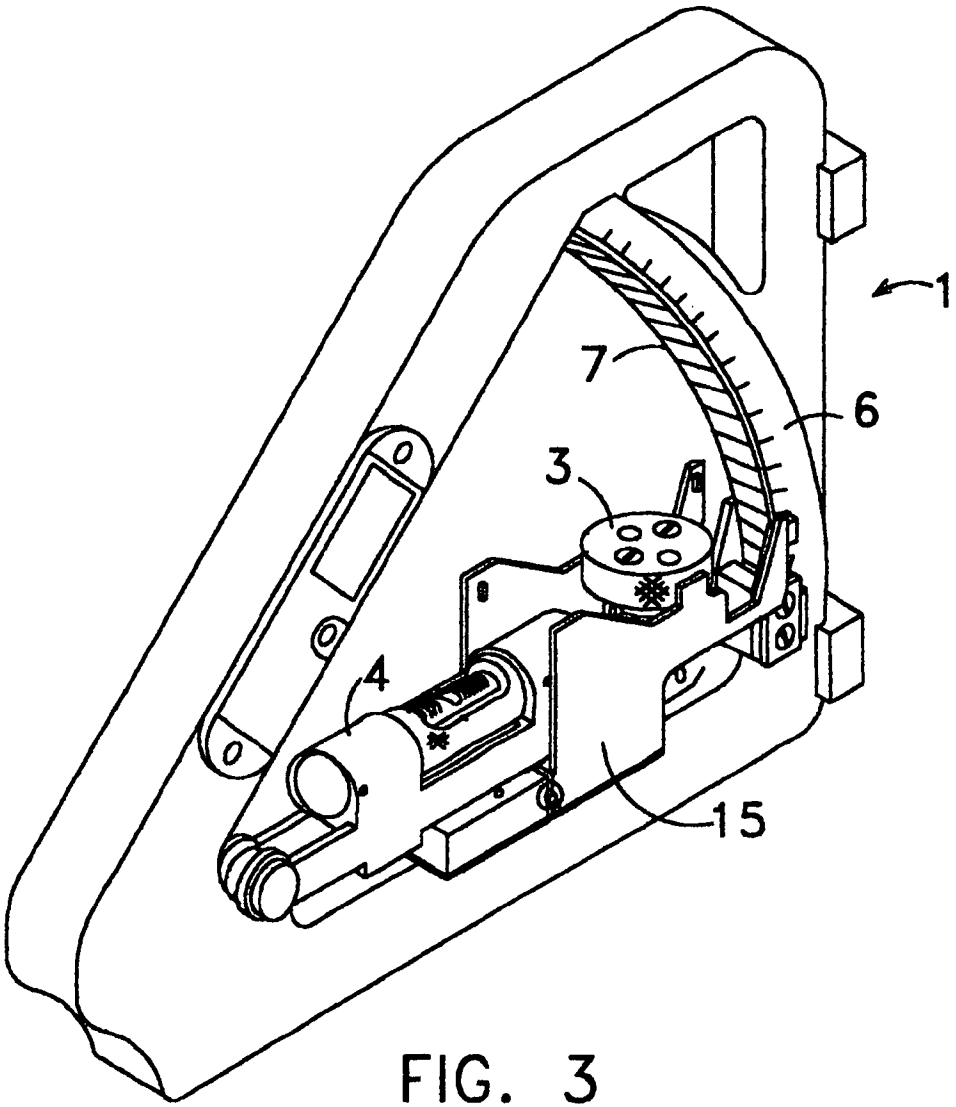
FIG. 3 shows a combination of a quadrant lighting apparatus of the present invention attached to the M1 A1 Gunner's Quadrant.

Referring now to the following description and figures, there is shown preferred embodiments for a quadrant lighting apparatus of the present invention, including the technical features of the invention for which protection is sought. A quadrant lighting apparatus of the present invention includes a housing and a flexible circuit board. The flexible circuit board includes a light source that illuminates a Gunner's Quadrant. FIG. 3 shows a quadrant lighting apparatus 15 attached to a Gunner's Quadrant 1.

The housing is comprised of a durable material such as aluminum or a plastic. An aluminum housing may be made through machining or a stamping processes. A plastic housing may be made from molds or other conventional plastic working techniques. It is preferred to manufacture the housing from a single piece of stock material to maintain durability and rigidity of the quadrant lighting apparatus. The housing may include a switch for activating the quadrant lighting apparatus.

In the manufacturing process of the quadrant lighting apparatus, the flexible circuit board attaches or adheres to the housing. The flexible circuit board attaches or adheres to a bottom surface of the housing and a top surface of the housing. The flexible circuit board includes the light source. In a preferred embodiment, LEDs are used as the light source to provide illumination for the Gunner's Quadrant. The flexible circuit board also contains electrical connections and other necessary electrical components for the operation of the quadrant lighting apparatus.

The housing also comprises a battery compartment for one or more batteries. A particularly preferred embodiment shown and described has two batteries. A cover plate removably attaches to the housing to contain the batteries. In the preferred embodiment, the cover plate is located on the bottom of the housing. The batteries may be held in position within the battery compartment by a "dog-bone" piece. The dog-bone piece assists in securing the batteries and the switch and provides an electrically conductive path for the batteries through a conductive clip adjacent to the dog-bone. In the preferred embodiment illustrated in the drawings, the dog-bone piece's shape snugly accommodates two round batteries in the housing and provides stability to the batteries and the switch within the housing.

As previously indicated, the housing may be made from a plastic material. Suitable plastic materials include 33% glass filled plastic nylon or investment casting.

The flexible circuit board may be comprised of multiple layers, such as an adhesive layer, a backing layer, a layer of electrical components forming a circuit, and an optional cover. The adhesive layer may include a modified acrylic type adhesive. In certain embodiments, the adhesive layer may be omitted and adhesives may be used to adhere the flexible circuit board to the housing. The backing layer may include a polyimide material. The backing layer may be approximately 0.002 inches thick. The circuit and its electrical components include resistors, LEDs, and other electrical connections. Finally, a cover to protect the components is applied. The cover may include typical paints or other coating to protect the components. Other layers may be included as well.

The weight of the quadrant lighting apparatus may be reduced to approximately 0.075 kilograms to approximately 0.085 kilograms by using light weight materials. A preferred embodiment of the quadrant lighting apparatus weighs approximately 0.077 kilograms by using the light weight materials. This is a fraction of the weight of the Gunner's Quadrant, which weighs approximately 1.978 pounds alone and with the M82 Carrying Case approximately 3.659 pounds.

The present invention will now be discussed with reference to some preferred embodiments:

A housing 10 is shown in FIGS. 4-10. The housing 10 includes a right-wing 20 and a left-wing 30. In a preferred embodiment, the right-wing 20 and the left-wing 30 are integral to a base 40 to provide strength and durability to the housing 10. In other embodiments, the right wing and the left wing may be combined with the base to form the housing.

The base 40 is generally rectangular in shape and includes a hollow cavity below its top surface. The right-wing 20 and the left-wing 30 are generally perpendicular to the base 40 of the housing 10. The base 40 has a front mounting region 50 and a back mounting region 60. The front mounting region 50 and the back mounting region 60 removably attach or "clip" to a bottom surface of the Gunner's Quadrant via a clip 65 attached to the back mounting region 60. The quadrant lighting apparatus may removably attach to the Gunner's Quadrant by other conventional fastening means, such as bolts, brackets, and the like. In a preferred embodiment, the housing 10 is about 1.75 inches wide, about 4.25 inches long, and about 2.13 inches tall.

The base 40 includes a groove 425 and a bevel 427. The groove 425 allows the flexible circuit board to attach to a top surface 330 of the base and a bottom surface of the base 440.

Figure 1:
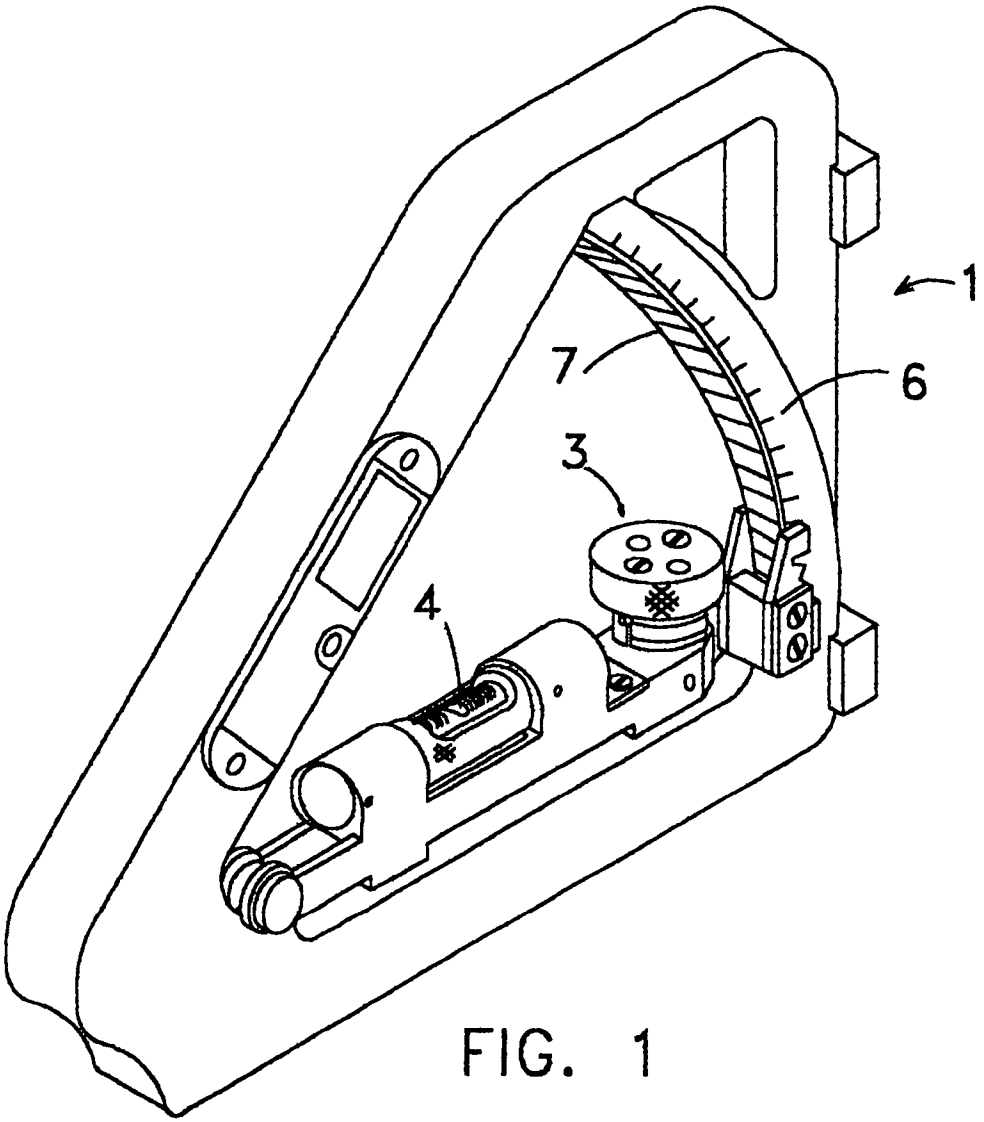
FIG. 1 shows an M1 A1 Gunner's Quadrant.
Figure 2:
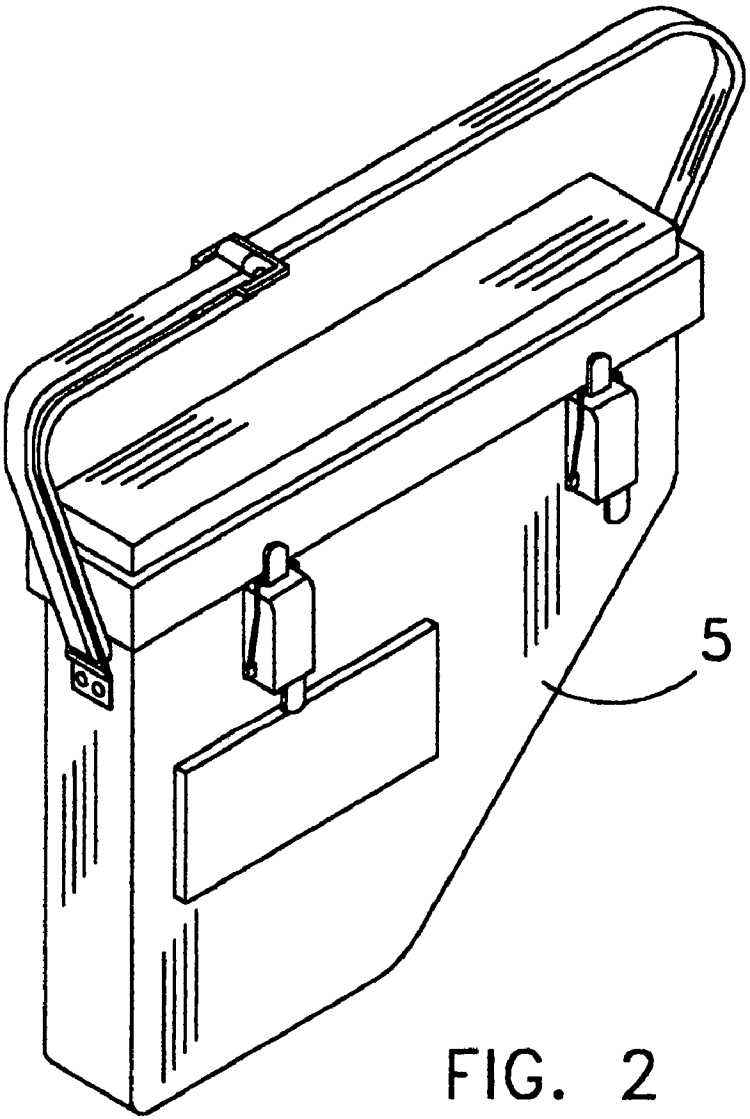
FIG. 2 shows an M82 Carrying Case.

After the flexible circuit board is adhered to the housing, the right-wing 20 and the left-wing 30 include the LEDs that provide illumination to the Gunner's Quadrant. The right-wing 20 and the left-wing 30 are generally shaped to position the LEDs proximate to the portions of the Gunner's Quadrant 1, shown in FIG. 1, requiring illumination, such as the micrometer 3, the scales 6 and 7, and the liquid level bubble vial 4, shown in FIG. 1.

Figure 11:
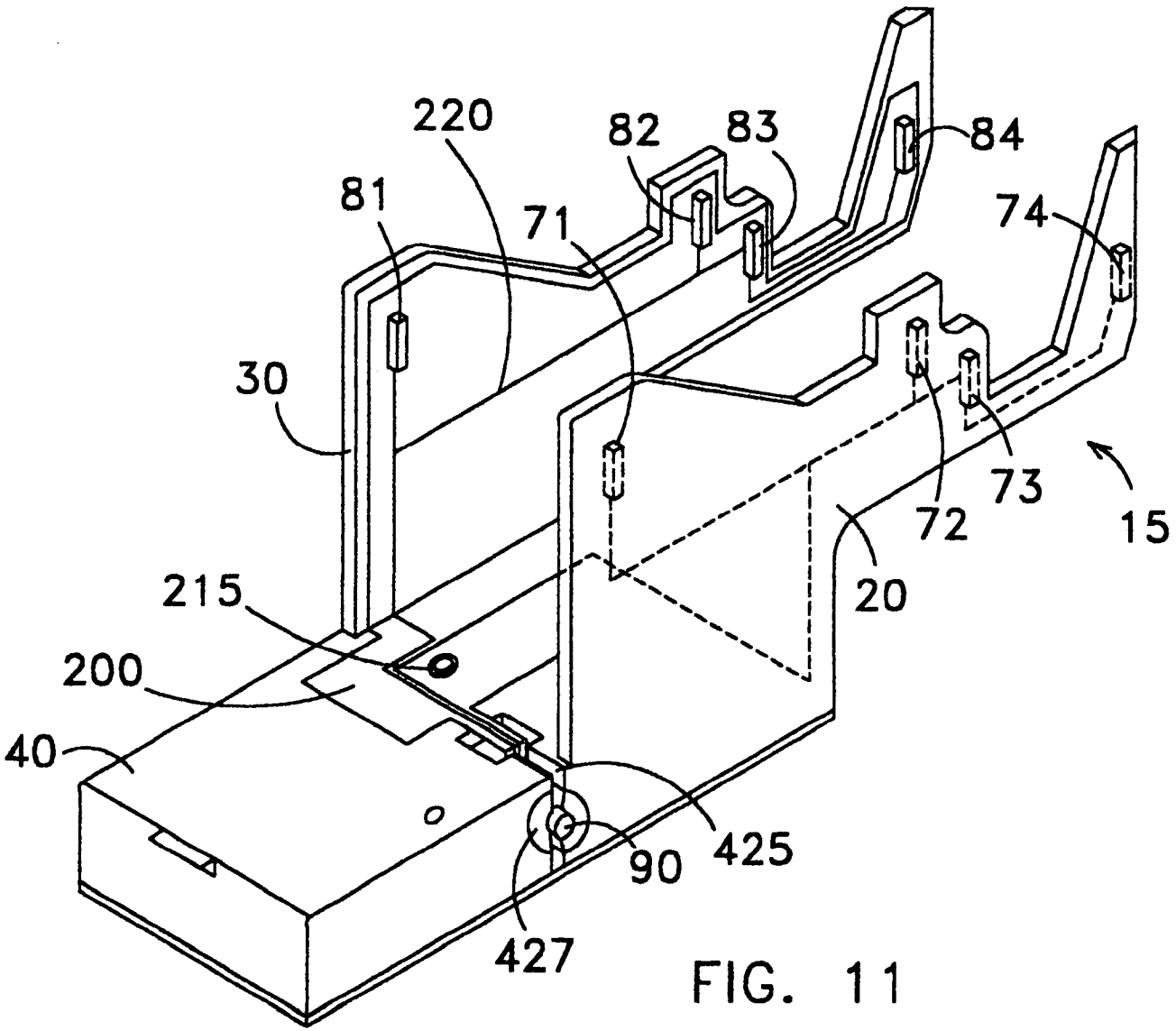
FIG. 11 shows an isometric view of a quadrant lighting apparatus of the present invention.

FIG. 11 shows a flexible circuit board 200 attached to the housing 10 to comprise a quadrant lighting apparatus 15. As shown in FIG. 11, the right-wing 20 includes a first right LED 71, a second right LED 72, a third right LED 73, and a fourth right LED 74. With continued reference to FIG. 11, the left wing 30 includes a first left LED 81, a second left LED 82, a third left LED 83, and a fourth left LED 84. The housing also includes a switch 90 that controls the on/off function of the quadrant lighting apparatus 15.

Figure 12:
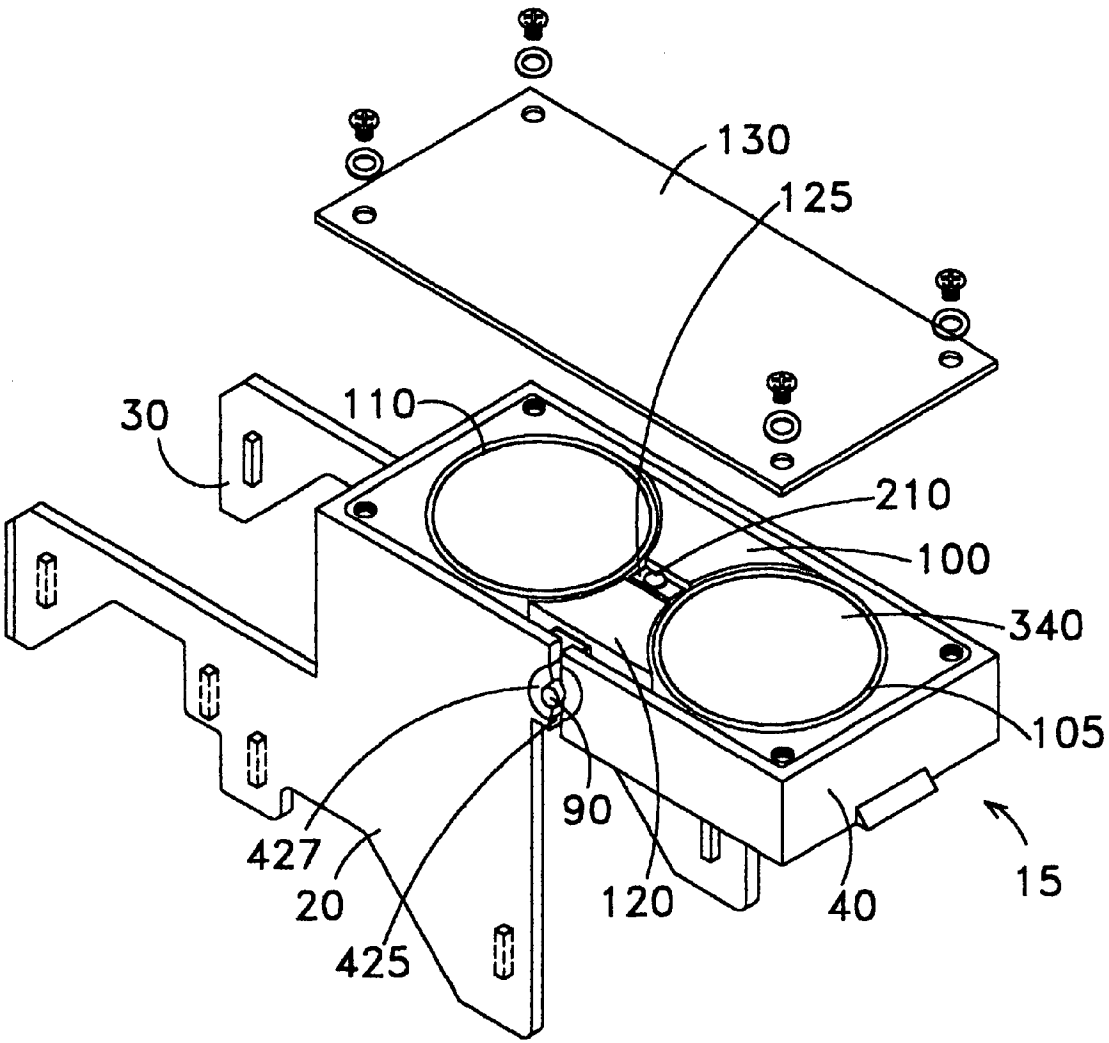
FIG. 12 shows an inverted isometric and exploded view of the quadrant lighting apparatus of the present invention.

With reference to FIG. 12, a battery compartment 100 is shown in the bottom of the base 40. The battery compartment 100 includes a front compartment 105 and a rear compartment 110, which are defined by a dog bone piece 120 and the base 40. Over the dog bone piece 120 is a conductive clip 125. A cover plate 130 completes the battery compartment 100. The cover plate 130 may attach to the housing via screws or socket heads or other conventional fastening means.

The flexible circuit board 200 with electrical wiring 220, as shown in FIG. 11, adheres to the housing 10 by an adhesive carried by the flexible circuit board 200 to comprise the quadrant lighting apparatus 15. After the adhering of the flexible circuit board 200 to the housing 10, the quadrant lighting apparatus 15 may be masked and coated with a sprayed on primer and top-coat, such as 383 green CARC coating per Mil-STD-171, to protect the electrical components from ambient conditions encountered during use of the weapon or elements or physical abuse or both. The spray adhesive may be selected to reduce glare as well.

The battery system of the present invention will now be discussed in detail. Three-volt batteries are suitable for use with this invention. A preferred battery is a Panasonic® CR2477. These CR2477 batteries are readily available off the shelf. They may provide 4-5 years of service assuming that the quadrant lighting apparatus is not activated. The batteries may be readily replaced in the field by the operator by removing the cover plate.

Figure 13:
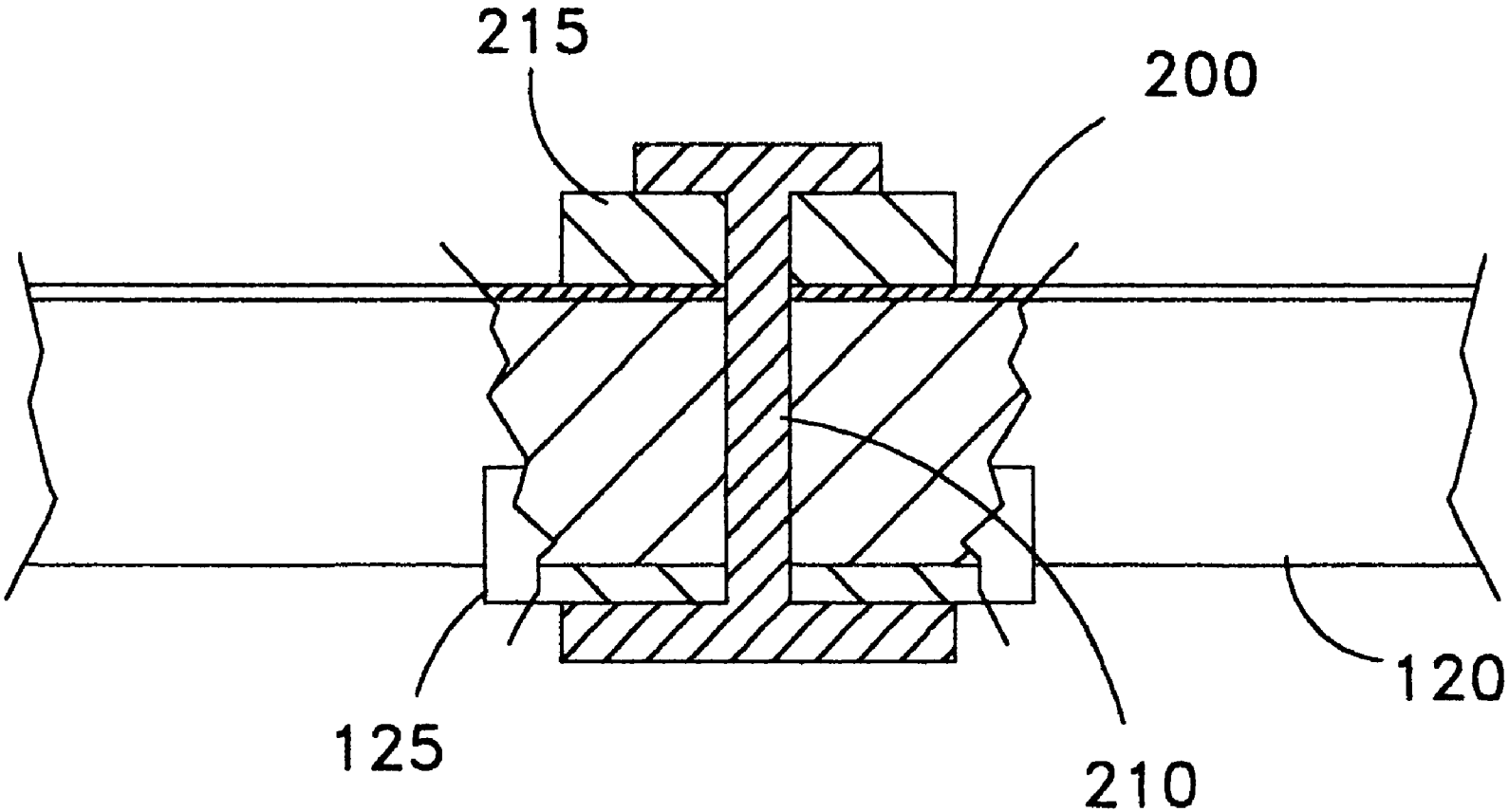
FIG. 13 shows a cross-section view of a dog bone, a conductive clip, a bolt, a washer and a circuit board of the quadrant lighting apparatus of the present invention.

The batteries are contained in the front and rear compartments 105 and 110. The dog bone 120 is attached to the housing 10 via a bolt 210. As shown in FIG. 13, the bolt 210 extends through the dog bone 120 and through a passage 42 in the housing 10 to a surface of the housing 10 where fastening means, such as a crimped rivet and washer 215, act as an electrical conductor between the flexible circuit board 200 on the surface of the housing 10 and the batteries. The bolt 210 also secures the conductive clip 125 to the dog bone. The conductive clip 125 provides a negative connection for the batteries in the front and rear compartments 105 and 110, while the flexible circuit board 200 provides the positive connection for the batteries.

An important aspect of the present invention is the focus angles of the LEDs. By directing each of the LEDs in particular directions, the light signature of the quadrant lighting apparatus is reduced and thus, a "hot spot" which could reveal the position of the artillery piece or howitzer to enemy combatants is less likely to be created. In the preferred embodiment shown in FIG. 3, the first right LED 71 is directed to the liquid level bubble vial 4, the second right LED 72 is directed to the micrometer 3, the third right LED 73 is directed to the micrometer 3, and the fourth right LED 74 is directed to the right elevation scale 6. In this embodiment, the first left LED 81 is directed to the liquid level bubble vial 4, the second left LED 82 is directed to the micrometer 3, the third left LED 83 is directed to the micrometer 3, and the fourth left LED 84 is directed to the left elevation scale 7. This is one preferred arrangement for the LEDs. Other suitable arrangements may be employed that illuminate the level, the scales, and the micrometer of the quadrant lighting apparatus. In a preferred embodiment, all of the LED's are "right angle" LEDs. In this preferred embodiment, extra material for supporting an individual LED may be used to direct the individual LED to a specific point on the quadrant lighting apparatus. In other embodiments, a combination of "right angle" and 45° LEDs may be used.

In other embodiments of the present invention, a variety of LEDs and LED locations may be selected. Embodiments with six LEDs provide sufficient illumination while not creating a noticeable light signature or hot spot. Preferred LEDs for use with the quadrant lighting apparatus have a wavelength range of about 550 nanometers to about 650 nanometers. This wavelength range is generally not detectable from a distance by enemy combatants using night vision equipment with infrared technology. Adjusting the electrical current by the use of resistors in the flexible circuit board achieves the desired brightness and wavelength. In other embodiments of the present invention, ten LEDs may be used and provide sufficient illumination while not creating a noticeable light signature.

The flexible circuit board of the present invention will now be discussed in general terms. The flexible circuit board includes an adhesive backing to adhere the flexible circuit board to the housing. The flexibility of the flexible circuit board allows the flexible circuit board to bend and wrap around the angles and to the bottom surfaces of the housing as needed to assemble the quadrant lighting apparatus. The flexible circuit board follows or molds to the respective contours of the housing. The flexible circuit board preferably includes a single piece of flexible circuit board. This is intended to reduce the likelihood or the probability of breaks or shorts in the circuit and to provide a more durable finished product.

The flexible circuit board includes the LEDs and the necessary electrical connectivity between the LEDs. Other electrical components in the flexible circuit board include resistors and the like. The flexible circuit board may also include the on switch for the device.

The flexible circuit board may be programmed to provide an automatic shut-off timer for the quadrant lighting apparatus. For example, after the operator turns "on" the quadrant lighting apparatus, the quadrant lighting apparatus may automatically shut off after a predetermined time, such as approximately two to approximately five minutes when appropriately constructed or programmed.

Figure 4:
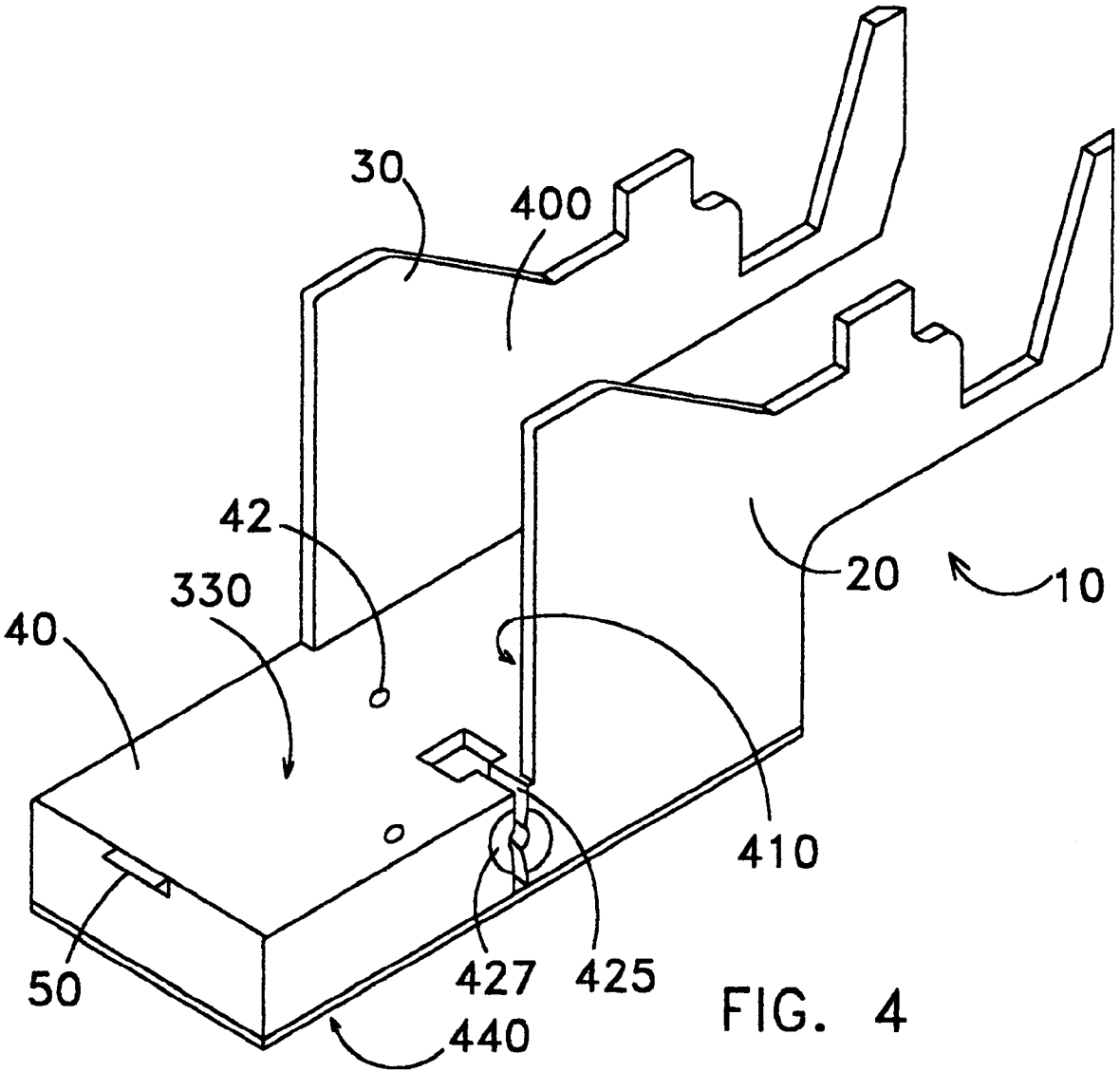
FIG. 4 shows an isometric view of a frame for the quadrant lighting apparatus of the present invention.
Figure 5:
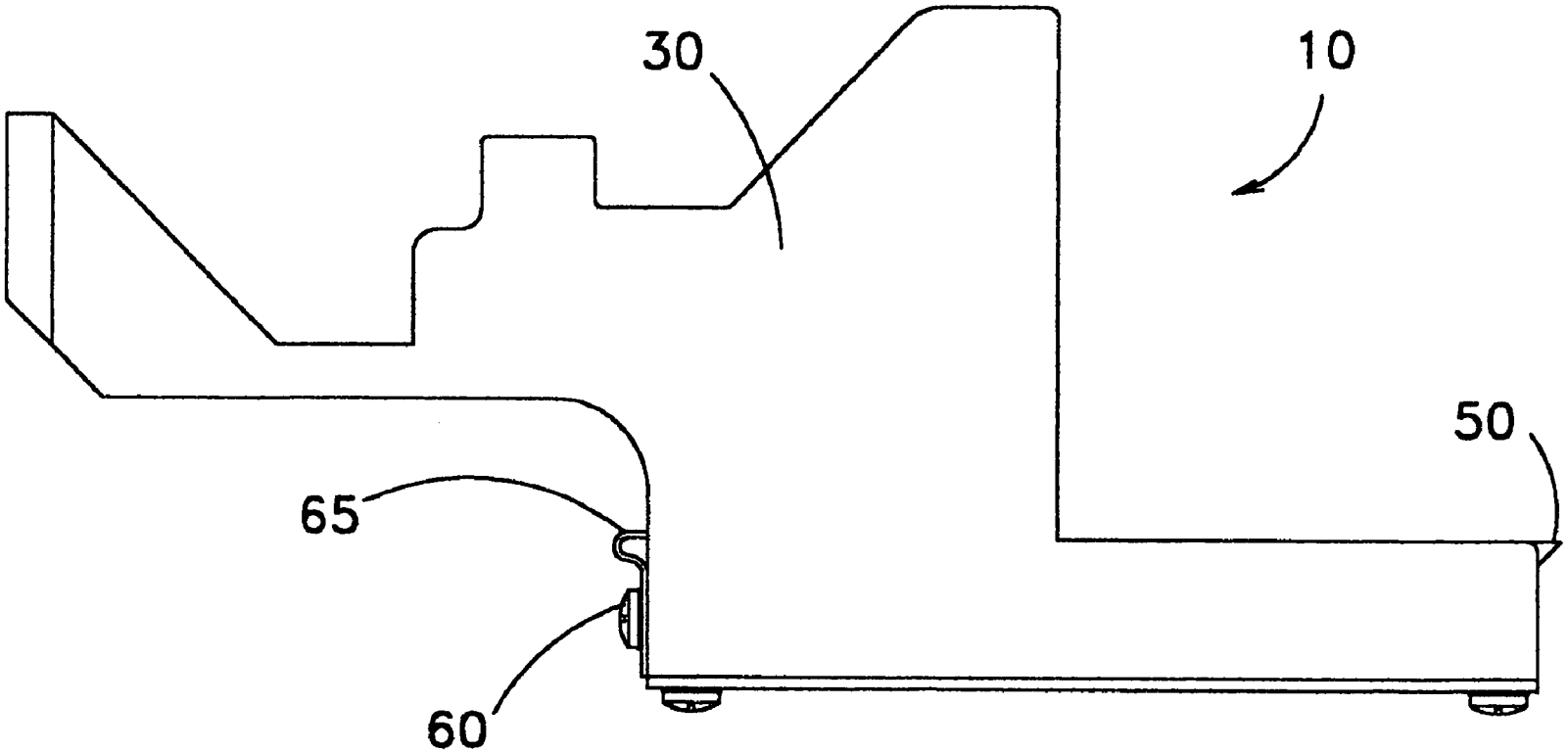
FIG. 5 shows a left side view of the frame for the quadrant lighting apparatus of the present invention.
Figure 6:
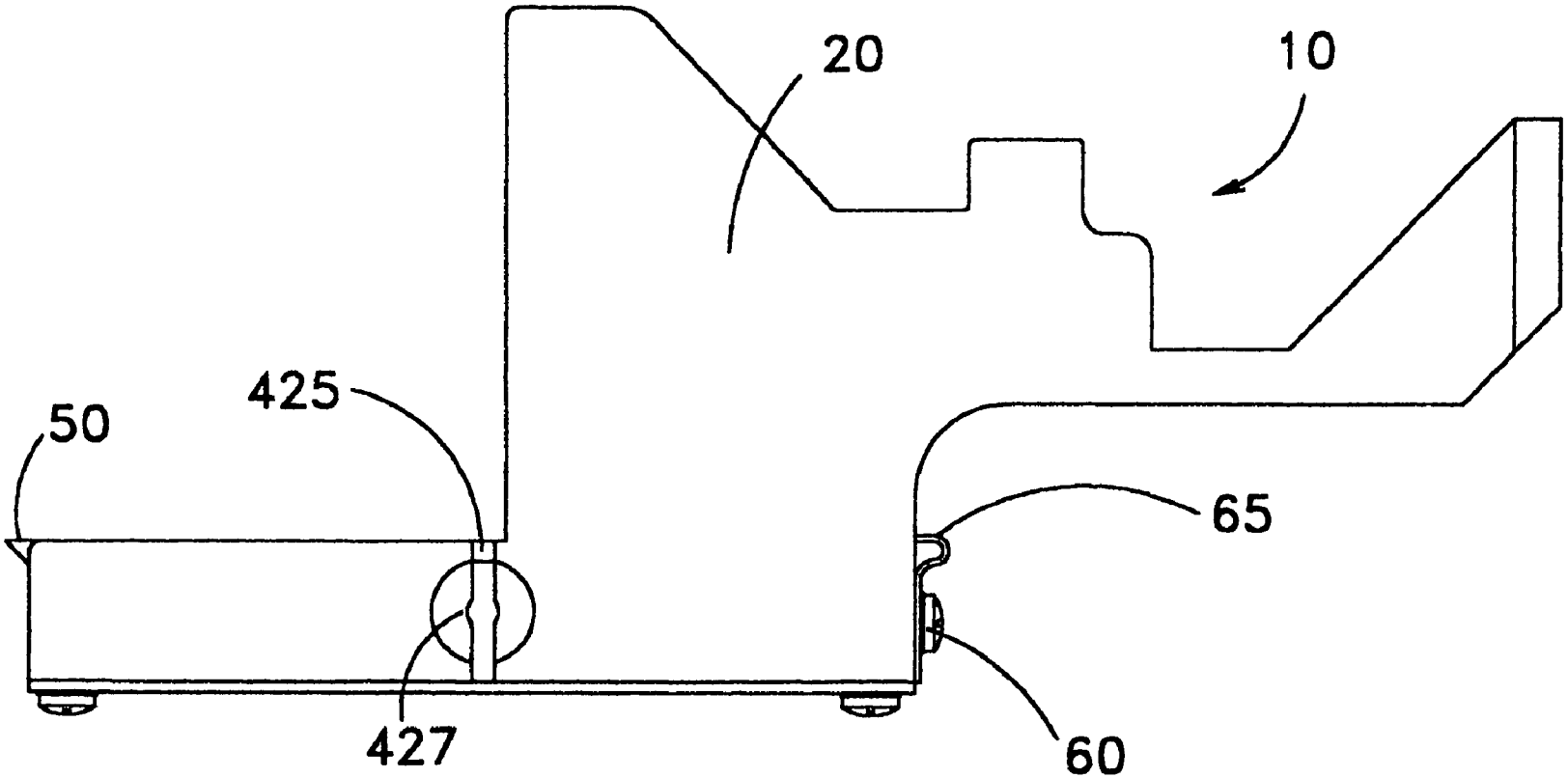
FIG. 6 shows a right side view of the frame for the quadrant lighting apparatus of the present invention.
Figure 8:
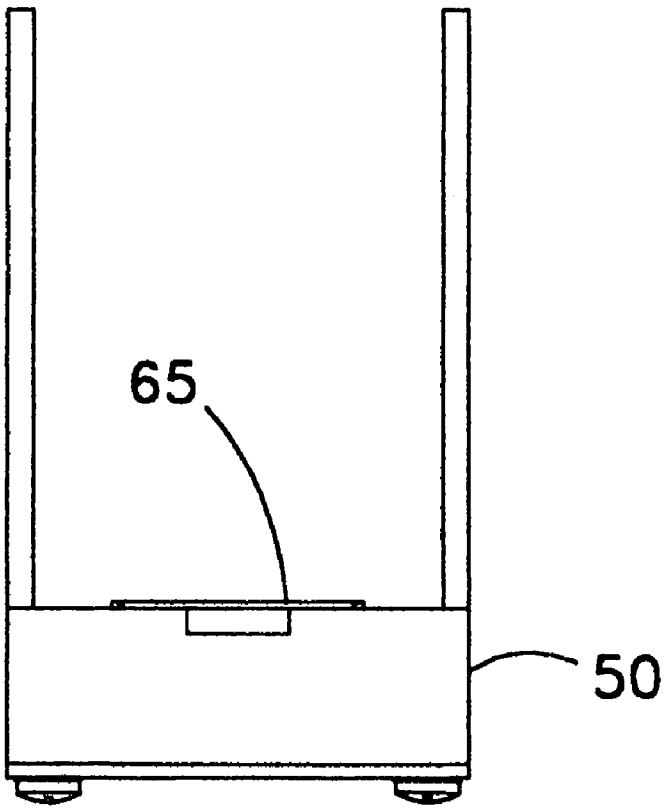
FIG. 8 shows a rear view of the frame for the quadrant lighting apparatus of the present invention.
Figure 7:
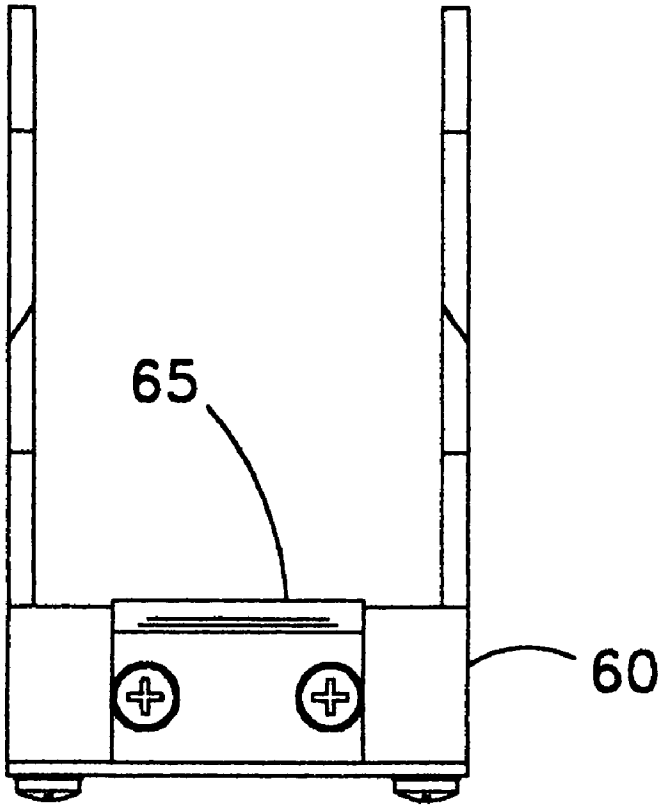
FIG. 7 shows a front view of the frame for the quadrant lighting apparatus of the present invention.
Figure 9:
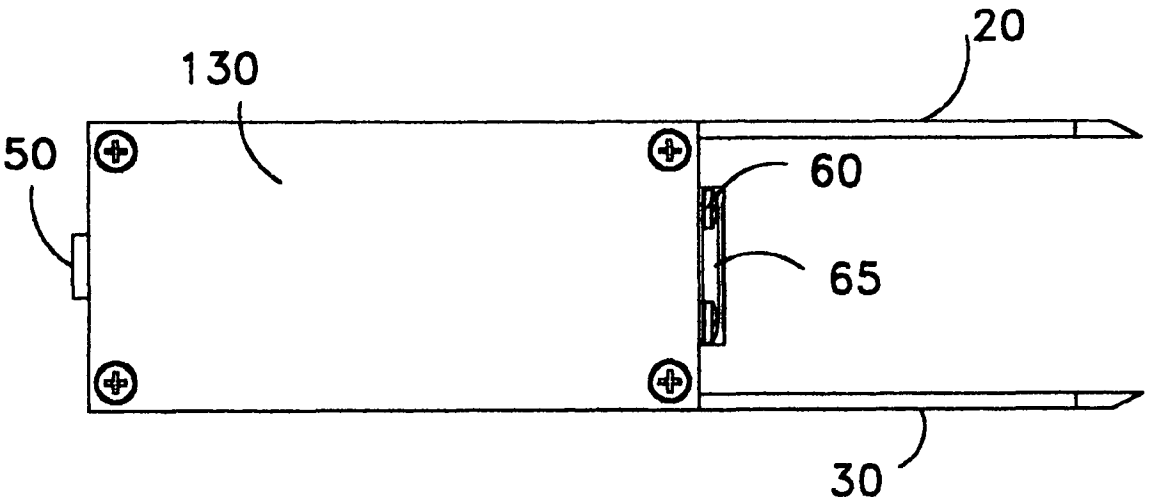
FIG. 9 shows a bottom view of the frame for the quadrant lighting apparatus of the present invention.
Figure 10:
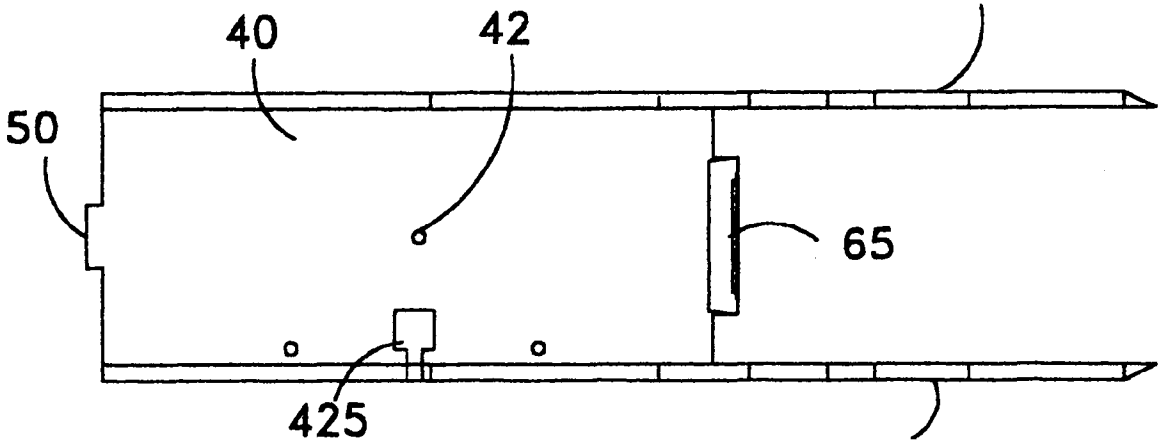
FIG. 10 shows a top view of the frame for the quadrant lighting apparatus of the present invention.
Figure 14:
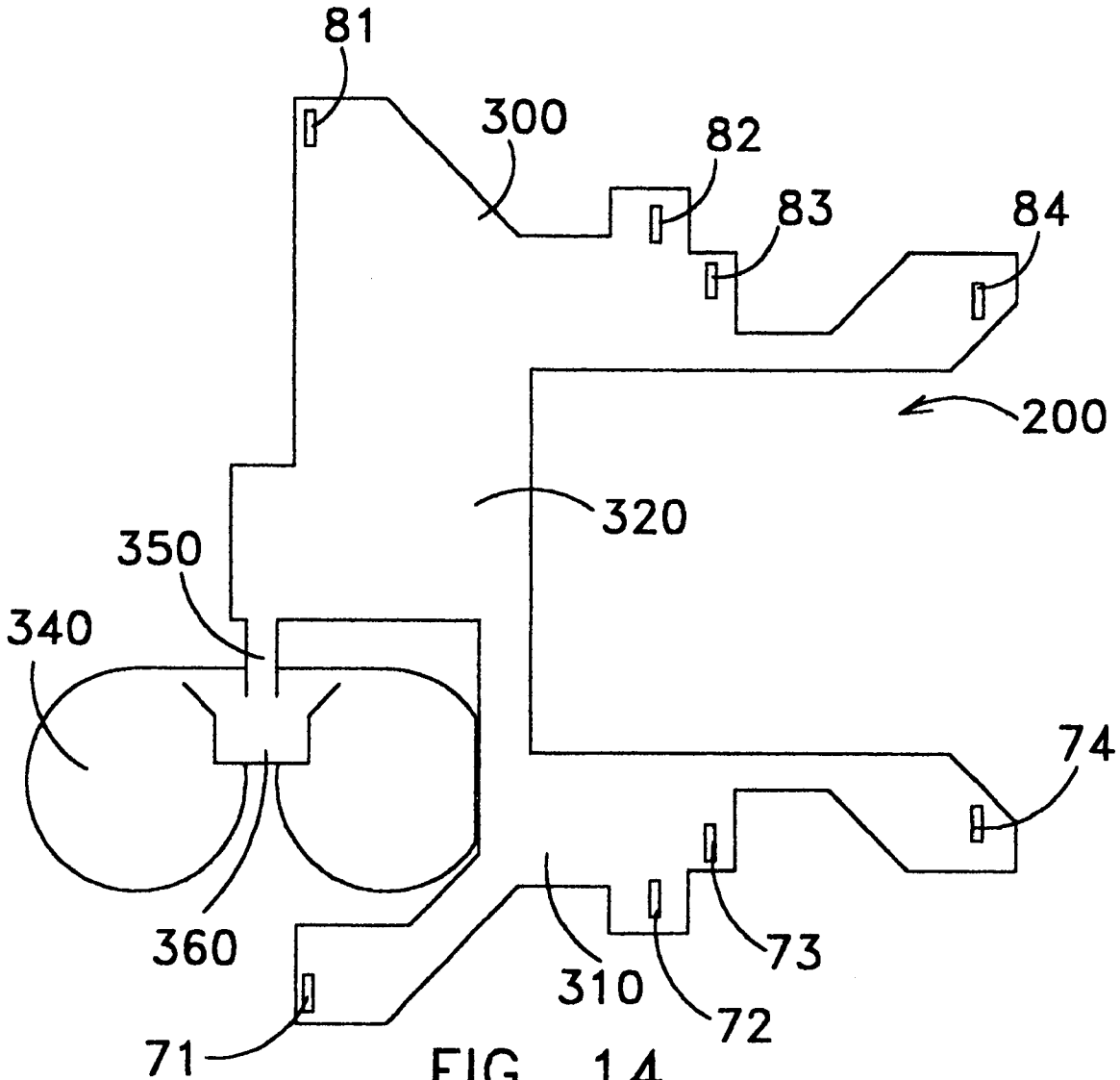
FIG. 14 shows a flexible circuit of the present invention.

As previously described, the flexible circuit board provides the positive contact for the batteries. A preferred flexible circuit board is shown in FIG. 14. During the manufacture of the quadrant lighting apparatus of the present invention, the flexible circuit board is layered and printed with all the necessary electrical components. Next, the flexible circuit board is attached to the housing via the adhesive carried by the flexible circuit board. With reference to FIGS. 4 and 14, a left-wing portion 300 of the flexible circuit board 200 is attached to an interior portion 400 of the left wing 30. A right-wing portion 310 of the flexible circuit board 200 is attached to an interior portion 410 of the right-wing 20. A middle portion 320 of the flexible circuit board 200 is attached to the top surface 330 of the base 40 and a battery portion 340 of the flexible circuit board 200 is attached to the bottom surface 440 of the base 40. The battery portion 340 of the flexible circuit board bends at a transition point 350 to wrap underneath and attach to the bottom surface 440 of the base 40. The transition point 350 bends through the groove 425 in the base 40 of the housing 10. A switch portion 360 provides the electrical operation for the switch 90. The switch 90 contacts the switch portion 360 through the opening 425.

Figure 15:
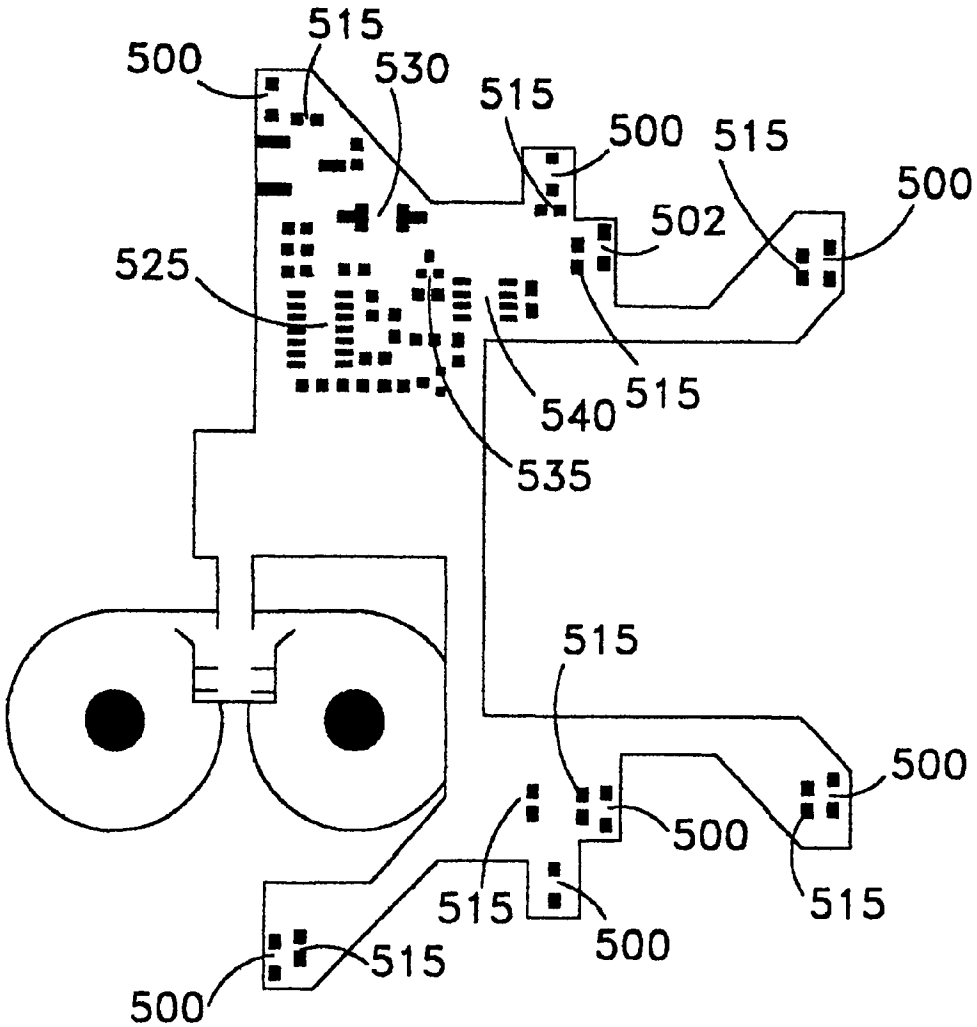
FIG. 15 shows a first detailed view of the flexible circuit of the present invention.
Figure 16:
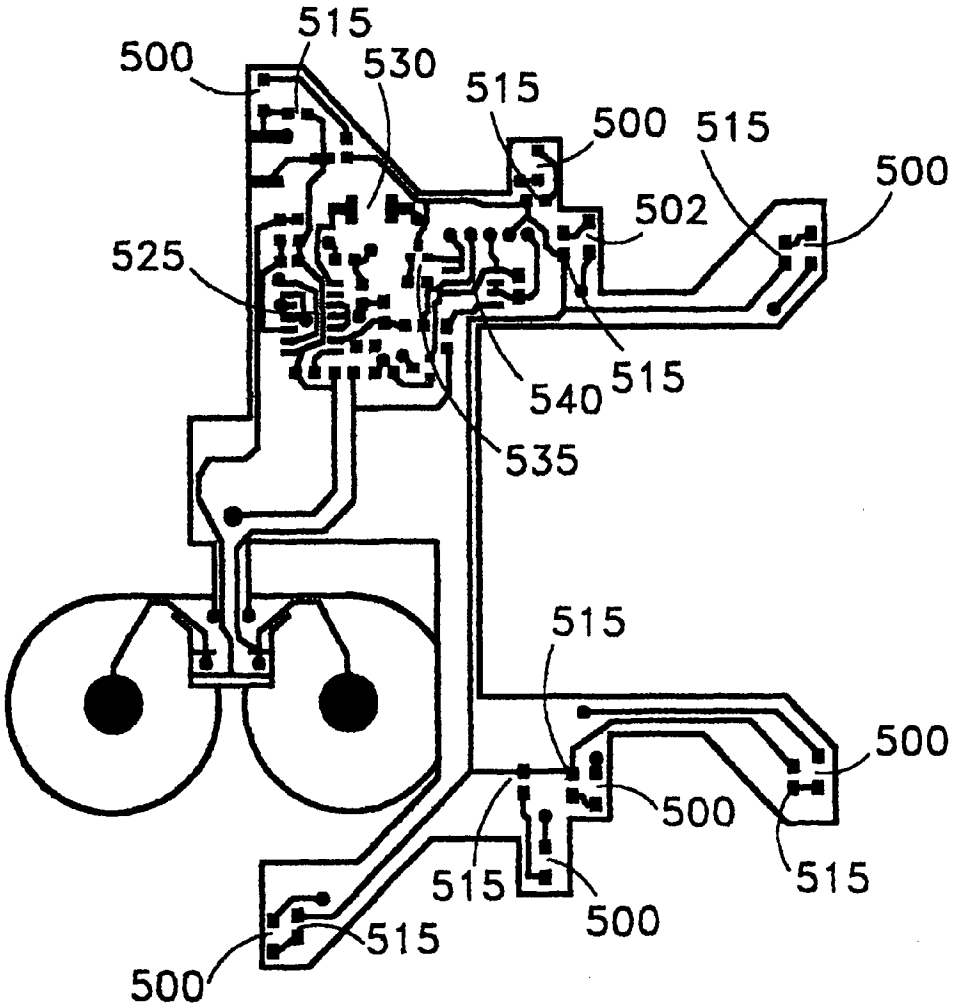
FIG. 16 shows a second detailed view of the flexible circuit board of the present invention.
Figure 17:
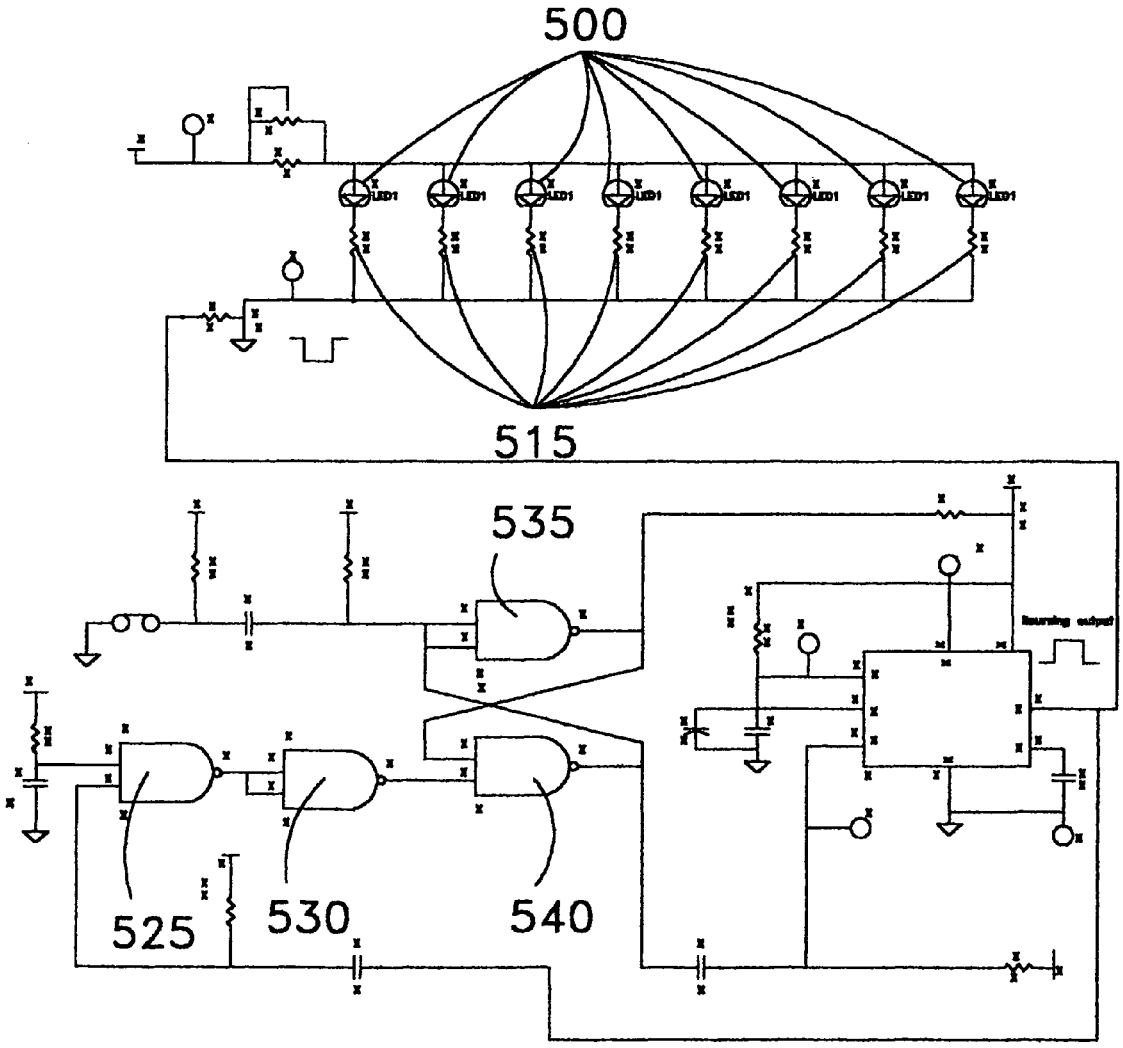
FIG. 17 shows an electrical schematic view of the flexible circuit board of the present invention.

FIGS. 15-17 show an electrical configuration for the flexible circuit board 200. The circuit generally comprises four parts, LED Intensity Circuitry, a Timer Circuit, a Set Signal, and a Reset Sequence. The first part of the circuit is the LED Intensity Circuitry which provides for different amounts of current to be sent to each LED 500 so that each LED 500 has a different intensity. Additionally, the amount of current going to all of the LEDs 500 may be changed by the use of different resistors 515. All choices described should be made at the time of manufacturing the circuit.

The second part of the circuit is the Timer Circuit. Whether the LEDs 500 are in an "on" or "off" state is determined by the output of the Timer Circuit. The Timer Circuit is preset for a particular period of time during the manufacturing process. In other embodiments, the time period of the timer is made variable by using different components in the Timer Circuit. The timer is turned "on" by a Set Signal, and when the timer turns "off," a pulse is generated that initiates a Reset Sequence.

The Set Signal, which starts the timer, is triggered by a single AC pulse created from the pushing of the switch 90. Similarly, the output of the timer circuit creates a pulse that resets the entire circuit.

With particular reference to FIGS. 15-17, a "Quad Two-Input Nand" device 525 is shown for the Set and Reset sequences described above, a Tantalum Capacitor 530 is used as the "On Time Cap," a NPN Transistor 535 is used as the "on" switch, and a Low Power Linear Timer Chip 540 is used in the Timer Circuit.

Mechanically, this flexible circuit design provides many advantages. The use of a flexible circuit increases the dependability and reduces the cost associated with wire. The battery contacts are also an integral part of the flexible circuit. The housing forms a conductor for the circuit.

Although preferred embodiments of the present invention include the quadrant lighting apparatus being removably connected to the Gunner's Quadrant, one of ordinary skill in the art will realize that there are embodiments of the present invention in which the quadrant lighting apparatus may be permanently attached or affixed or incorporated onto the Gunner's Quadrant.

As evident from the foregoing description, certain aspects of the present invention are not limited by the particular details of the examples illustrated herein, and it is therefore contemplated that other modifications and applications, or equivalents thereof, will occur to those skilled in the art. It is accordingly intended that all claims shall cover all such modifications and applications that do not depart from the spirit and the scope of the present invention.

What is claimed is:

1. A lighting apparatus for a gunner's quadrant comprising:
a housing;
a flexible circuit board; and
lighting means for illuminating portions of the gunner's quadrant, wherein the illuminated portions are a liquid level, a micrometer, and an elevation scale.

2. The lighting apparatus for the gunner's quadrant according to claim 1, wherein the lights do not create a light signature.

3. The lighting apparatus for the gunner's quadrant according to claim 1, wherein the lighting apparatus removably attaches to either a M1 A1 or a M1 A2 Gunner's quadrant.

4. The lighting apparatus for the gunner's quadrant according to claim 3, wherein the lighting apparatus, after attaching to the M1 A1 or M1 A2 Gunner's Quadrant, is then stored with the M1 A1 or M2 A2 Gunner's quadrant in a M82 carrying case.

5. The lighting apparatus for the gunner's quadrant according to claim 1, wherein the lights comprise a plurality of LEDs to provide the illumination for the gunner's quadrant.

6. The lighting apparatus for the gunner's quadrant according to claim 5, wherein the LEDs emit light with a wavelength of about 550 nanometers to about 650 nanometers.

7. The lighting apparatus for the gunner's quadrant according to claim 1, wherein the flexible circuit board comprises an adhesive layer, a backing layer, a layer of electrical components, wherein the electrical components include a plurality of LEDs, and an optional cover layer.

8. The lighting apparatus for the gunner's quadrant according to claim 1, wherein the housing includes a base, a right-wing and a left-wing;
wherein the right-wing and the left-wing are integral to the base.

9. The lighting apparatus for the gunner's quadrant according to claim 8, wherein the base is generally rectangular in shape and comprises a hollow cavity below a top surface of the base, and the right-wing and the left-wing are generally perpendicular to the base of the housing.

10. The lighting apparatus for the gunner's quadrant according to claim 8, wherein the right-wing comprises a first right LED, a second right LED, a third right LED, and a fourth right LED; and the left-wing comprises a first left LED, a second left LED, a third left LED and a fourth left LED.

11. The lighting apparatus for the gunner's quadrant according to claim 10, wherein the first right LED is directed to a liquid level bubble vial of the gunner's quadrant, the second right LED is directed to a micrometer of the gunner's quadrant, the third right LED is directed to the micrometer, and the fourth right LED is directed to scales of the gunner's quadrant, and the first left LED is directed to the liquid level bubble vial, the second left LED is directed to the micrometer, the third left LED is directed to the micrometer, and the fourth left LED is directed to the scales.

12. The lighting apparatus for the gunner's quadrant according to claim 1, wherein the flexible circuit board includes a single piece of flexible circuit board.

13. The lighting apparatus for the gunner's quadrant according to claim 1, wherein the housing includes a base, wherein the base comprises a battery compartment and the battery compartment includes a front compartment and a rear compartment.

14. The lighting apparatus for the gunner's quadrant according to claim 13, wherein the front and rear compartments are separated by a dog bone piece.

15. The lighting apparatus for the gunner's quadrant according to claim 1, wherein the housing includes a front mounting region and a back mounting region such that the lighting apparatus removably attaches or clips to a bottom surface of the gunner's quadrant.

16. The lighting apparatus for the gunner's quadrant according to claim 1, wherein the elevation scale comprises a left elevation scale and a right elevation scale.

17. A method of manufacturing a lighting apparatus for a gunner's quadrant comprising:

applying a flexible circuit board comprising lights to a housing, wherein the housing positions the lights to illuminate portions of the gunner's quadrant, wherein the portions are a liquid level, a micrometer, and a left and right elevation scale.

18. The method of manufacturing a lighting apparatus for a gunner's quadrant according to claim 17, further comprising:

attaching a left-wing portion of the flexible circuit board to an interior portion of a left wing of the housing;

attaching a right-wing portion of the flexible circuit board to an interior portion of a right wing of the housing;

attaching a middle portion of a flexible circuit board to a top surface of a base of the housing; and attaching a battery portion of the flexible circuit board to a bottom surface of the housing.

19. The method of manufacturing a lighting apparatus for a gunner's quadrant according to claim 18, further comprising:

bending the battery portion of the flexible circuit board at a transition point to wrap underneath the housing and attach to the bottom surface of the housing.

20. The method of manufacturing a lighting apparatus for a gunner's quadrant according to claim 17, wherein the flexible circuit board comprises a single piece of flexible circuit board.

21. A method of illuminating a gunner's quadrant, comprising:

attaching a lighting apparatus to a gunner's quadrant, wherein the lighting apparatus comprises a housing and a flexible circuit board comprising lights; and illuminating the gunner's quadrant with the lights.

22. The method of illuminating a gunner's quadrant according to claim 21, further comprising:

illuminating portions of a M1 A1 or M1 A2 Gunner's Quadrant.

* * * * *